US006584927B1

(12) United States Patent
Iversen et al.

(10) Patent No.: US 6,584,927 B1
(45) Date of Patent: Jul. 1, 2003

(54) GOLF CART SIGNAL FLAG SYSTEM

(76) Inventors: Clarence Iversen, 72 Clover Dr., Crystal Lake, IL (US) 60014; Gary Fischer, 106 Sherwood Dr., Cary, IL (US) 60013

( * ) Notice: Subject to any disclaimer, the term of this patent is extended or adjusted under 35 U.S.C. 154(b) by 724 days.

(21) Appl. No.: 08/918,920

(22) Filed: Aug. 27, 1997

(51) Int. Cl.[7] ..... G09F 17/00
(52) U.S. Cl. ..... 116/173; 116/29
(58) Field of Search ..... 73/865.9; 116/29, 116/52, 53, 173, 174, 175, 51, 209; 473/405

(56) References Cited

U.S. PATENT DOCUMENTS 3,785,331 A * 1/1974 Ferris ..... 116/63 R
4,719,798 A * 1/1988 Orkin ..... 73/189
4,926,161 A * 5/1990 Cupp ..... 340/572
4,926,785 A * 5/1990 Lamson ..... 116/209
5,540,181 A * 7/1996 Pearce ..... 73/170.15

* cited by examiner

*Primary Examiner*—Eric S. McCall
(74) *Attorney, Agent, or Firm*—Kajane McManus

(57) ABSTRACT

The golf cart signal flag system comprises a base which engages golf cart structure and which mounts thereto a chosen plurality of pivotable signal flags, each of which is identifiable as indicating a particular need, want or condition of players on the course to golf course personnel and/or other players. One or more flags may be raised simultaneously. If desired, the system may be created as part of a roof of a golf cart.

14 Claims, 3 Drawing Sheets

GOLF CART SIGNAL FLAG SYSTEM

BACKGROUND OF THE INVENTION

The present invention relates to a signal flag system for use on a golf cart. More particularly, the flag system includes structure for pivotably mounting any chosen plurality of flag bearing poles onto a golf cart. Each flag will symbolize a need or want of the players and, when raised, will elicit an appropriate response from course personnel.

PRIOR ART

Heretofore, various apparatus including a flag for signalling or indicating something have been proposed.

Most of these apparatus typically have included a single flag on a short pole which is either fixed in position or positionable.

However a system for providing the capability of sending one or more recognized signals to golf course personnel simultaneously has not been previously proposed.

SUMMARY OF THE INVENTION

Accordingly there is provided a signal flag system for a golf cart comprising at least one flag mounted to a pole having a free end which is mechanically engaged to the golf cart in a manner to rotate between a locked vertical position elevating the flag above the golf cart and a horizontal nonelevated position.

DESCRIPTION OF THE PREFERRED EMBODIMENT

Figure 1:
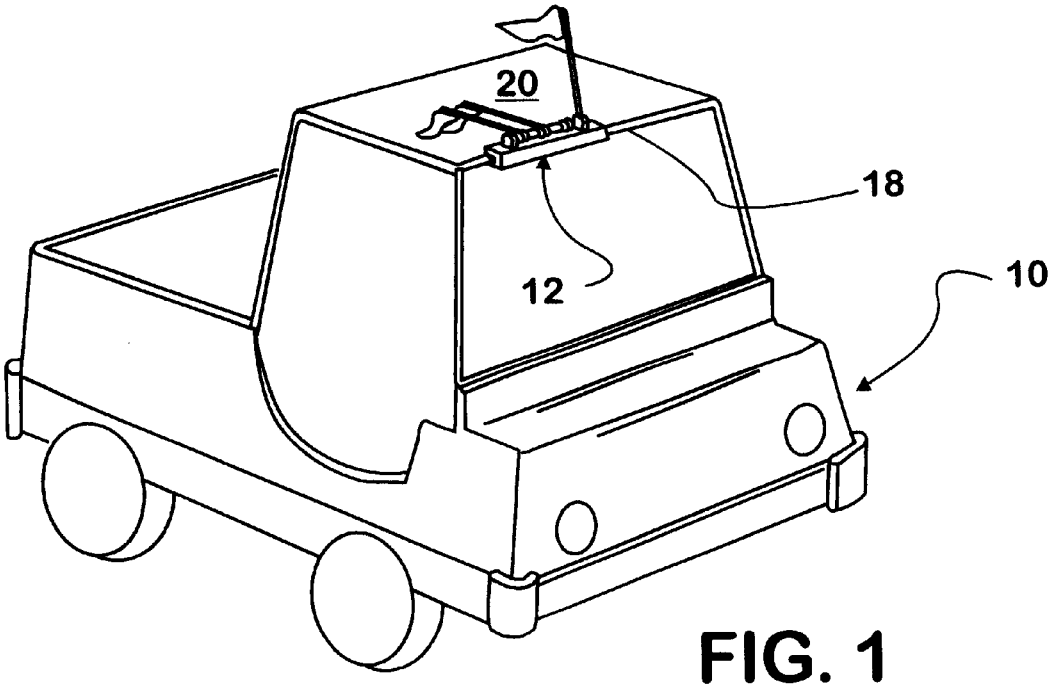
FIG. 1 is a perspective view of a golf cart showing the golf cart signal flag system made in accordance with the teachings herein removably mounted to a lip area of a roof of the cart.

Referring now to the drawings in greater detail, there is illustrated therein a golf cart 10 incorporating a golf cart signal flag system made in accordance with the teachings of the present invention and generally identified by the reference numeral 12.

Figure 2:
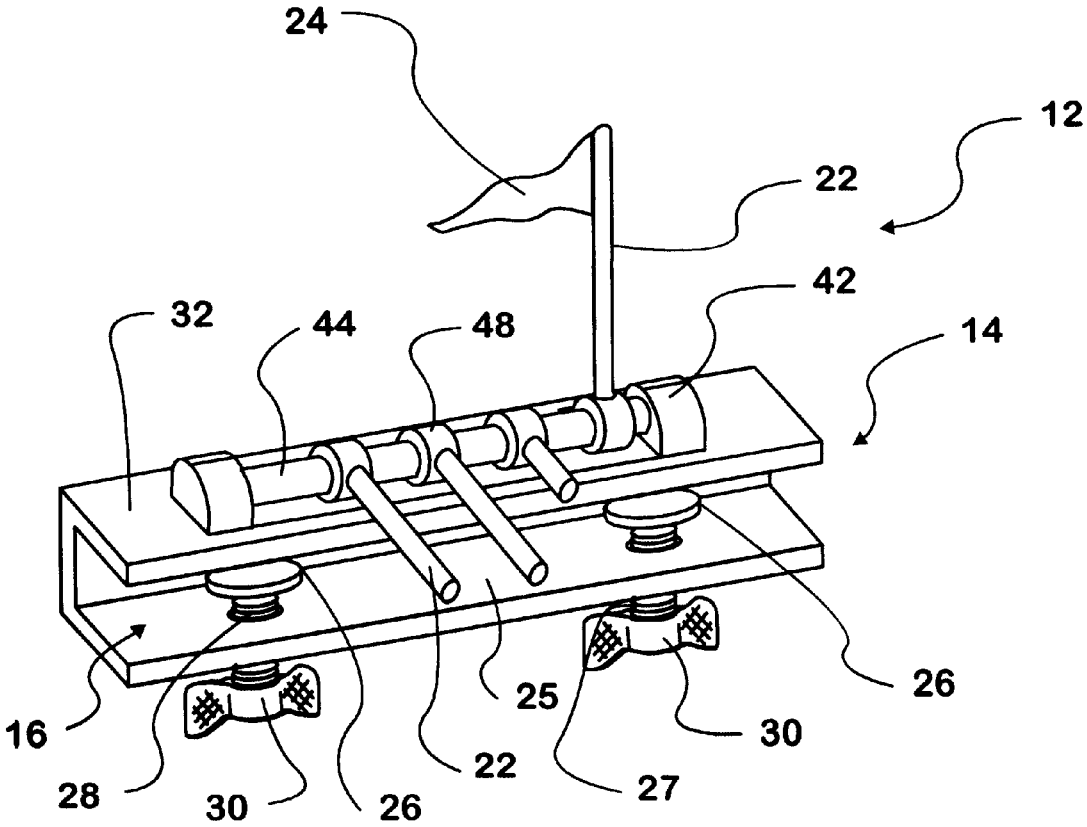
FIG. 2 is an enlarged perspective of the golf cart signal flag system of FIG. 1.

In FIGS. 1 and 2, a first embodiment of the system 12 is shown which includes a three sided base 14 having a channel 16 therein which is engageable to a lip 18 of a roof 20 of the golf cart 10.

Extending upwardly from the base 14 is a plurality of flag poles 22, each bearing a flag 24. The flag poles 22 are rotatable relative to the base 14 so that the flags 24 may be locked into an upright position or may be horizontally rested upon the roof 20. If desired, the flag poles 22 may be telescopic so that the flags 24 are clearly visible to golf course personnel, as well as other players.

Attachment of the base 14 to the roof lip 18 can be accomplished by any suitable means. For example, as best illustrated in FIG. 2, a plurality of pressure plates 26 may be threadedly disposed through one side 25 of the base 14 to rest within the channel 16. The pressure plate 26 has a threaded shaft 27 which extends through a port 28 in the side 25 of the base 14, with the shaft 27 having a winged opposite end 30, with rotation of the winged end 30 causing the plate 26 to move within and across the channel 16, locking the lip 18 of the roof 20 between the plate 26 and a side 32 of the base 14 opposed to the plate 26.

Figure 4:
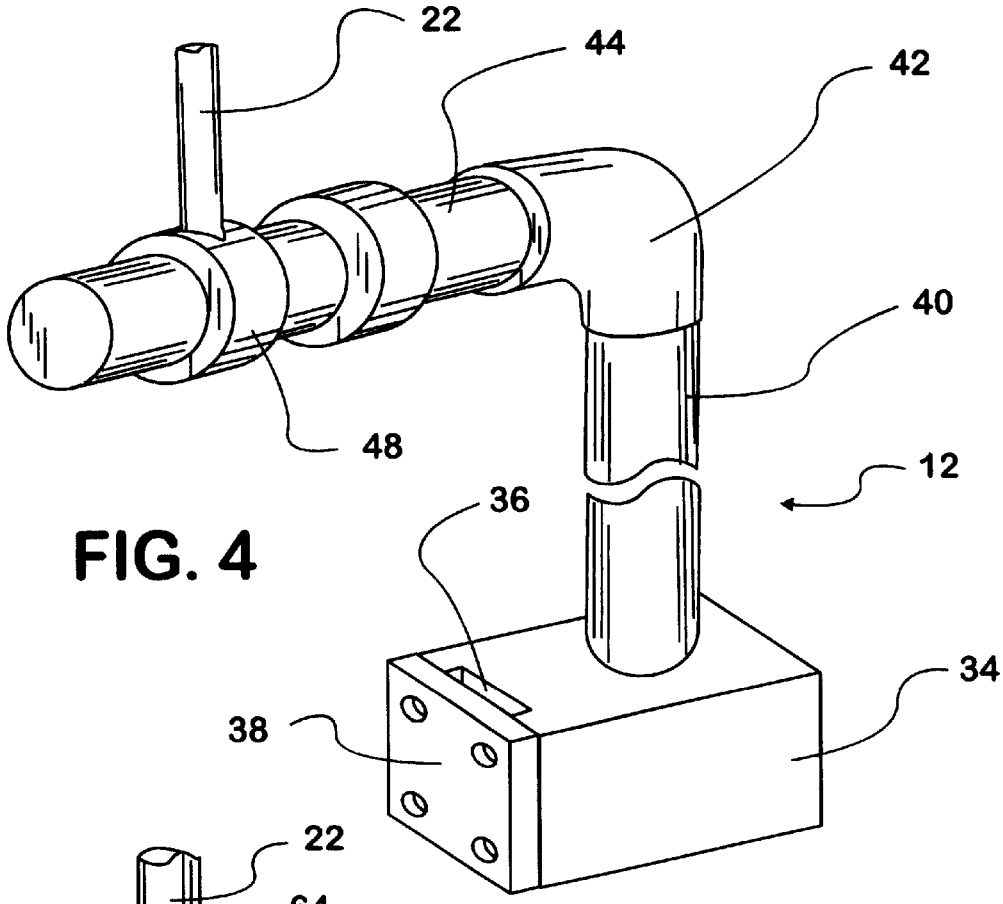
FIG. 4 is an enlarged view of the base of FIG. 3.
Figure 3:
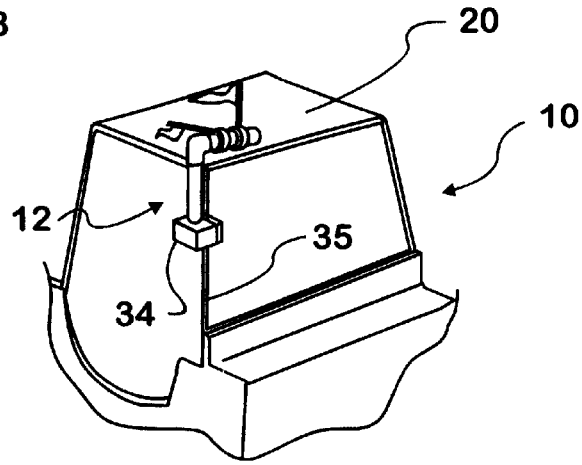
FIG. 3 is a view of a portion of a golf cart incorporating a roof support post and shows the golf cart signal flag system having a secondary embodiment of a base thereof for mounting the golf cart signal flag system to the post.

Turning now to FIGS. 3 and 4, there is illustrated therein a further embodiment of the system 12 which allows for engagement of the system 12 to an upright element of the golf cart 10, such as to a roof support 35.

Here, the base 34 also has a channel 36 therein, but the channel 36 now extends vertically through the base 34 and a cover plate 38 is provided which engages over the channel 36, to trap the roof support 35 frictionally within the channel 36.

Extending upwardly from the base 34 is an extension rod 40 which engages an end cap 42 of a support rod 44 to which the flag poles 22 are rotatably mounted in all embodiments.

The support rod 44 carries the plurality of rotatably engaged flags 24 in a manner allowing the flag poles 22 to be locked upright or to be lowered to a horizontal position as desired.

Although a maximum of four flags 24 are shown in the drawings, this is for purposes of illustration and brevity only and should not be construed as limiting.

Each flag pole 22 engages either removably or fixedly, a ring like collar 48 rotatably positioned about the support rod 44.

It will be understood that each flag pole 22 must lock into an upright position and such locking may be accomplished in any suitable manner.

Figure 5:
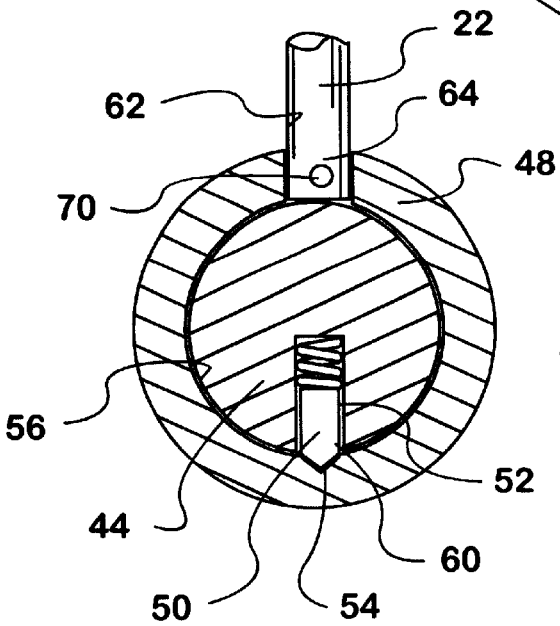
FIG. 5 is a cross sectional view through an area of the golf cart signal flag system where one flag pole is rotatably mounted.

For example, as illustrated in FIG. 5 the support rod 44 includes a spring biased pin 50 seated within a slot 52 therein which engages within a cooperating slot 54 provided in an interior surface 56 of the collar 48 at a radial position which is only engageable when the flag pole 22 is upright. In the embodiment shown, the biased pin 50 is downwardly disposed and the slot 54 is positioned directly across from the pole 22. When it is desired to lower the flag 24, rotational pressure applied against the collar 48 will cause a curved head 60 of the pin 50 to slide upwardly and out of the slot 54 riding along the interior surface 56 of the collar 48 until again aligned with and engaged within the cooperating slot 54.

A similar type of engagement is proposed for securing a removable embodiment of flag pole 22 within an opening 62 in the collar 48 provided for receiving a free end 64 of the flag pole 22 therein. Although not shown, it will be understood that a biased pin or nub extends into the opening 62 and engages within a cooperating slot 70 for same created in the pole 22 when the pole 22 is seated in desired rotational position within the opening 62 to maintain the flags 24 substantially parallel to one another.

Such releasable engagement between the pole 22 and the opening 62 in the collar 48 not only keeps the pole mounted flag 24 from being blown away by wind but also allows for a choice of flags 24 to be displayed.

In this respect, each of the flags 24 is indicative of a particular condition or action required from golf course personnel when locked in the upright position. Indicia such as color and/or marking for each flag 24 will be indicative of a service desired, or condition.

For example, a red flag 24 could be raised for signalling an emergency situation, a blue flag 24 could be raised to signal that beverages are desired, a further flag 24 could be raised to indicate the presence of a physically challenged player on the course, and so on. Thus, any number of flags 24 can be raised, singly or in various combinations, to produce desired results.

Obviously, when the desired result is obtained, the corresponding flag 24 will be lowered until needed again.

Figure 6:
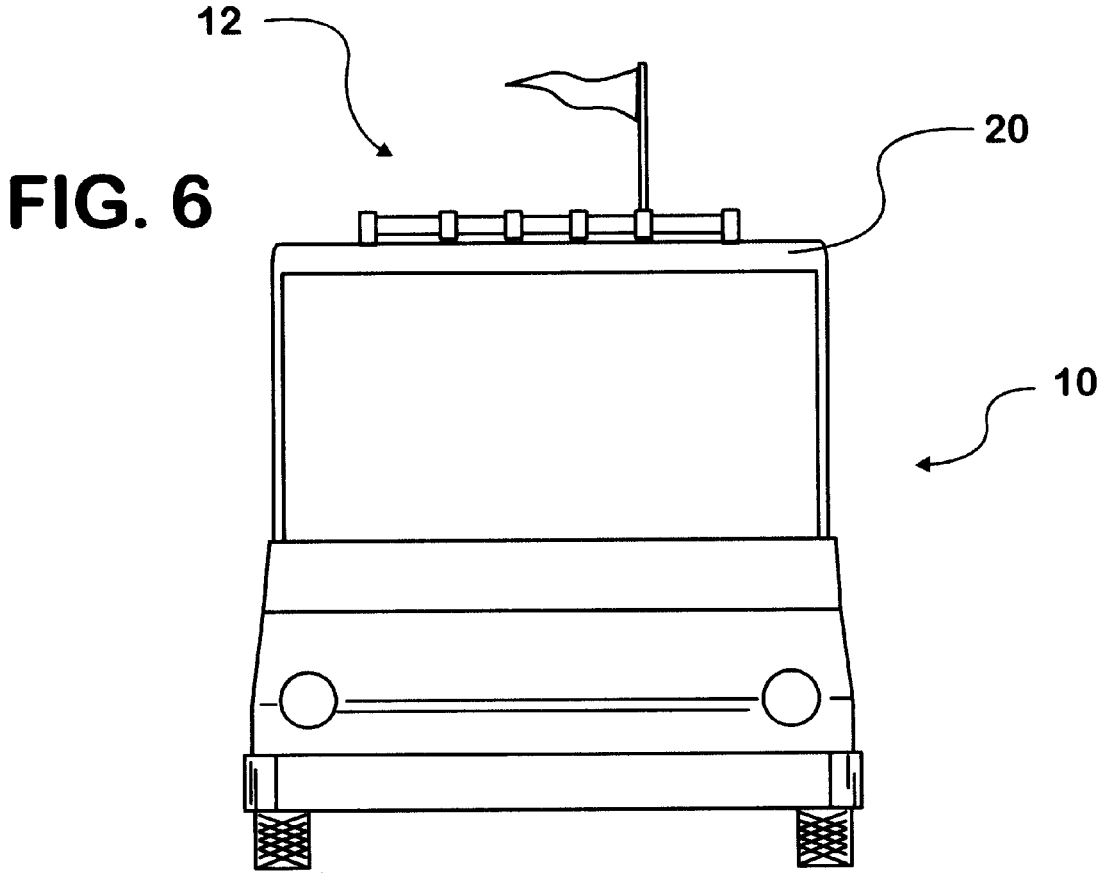
FIG. 6 is a front end view of a golf cart provided with the signal flag system and showing a further embodiment of the base incorporated into the roof of the cart.
Figure 7:
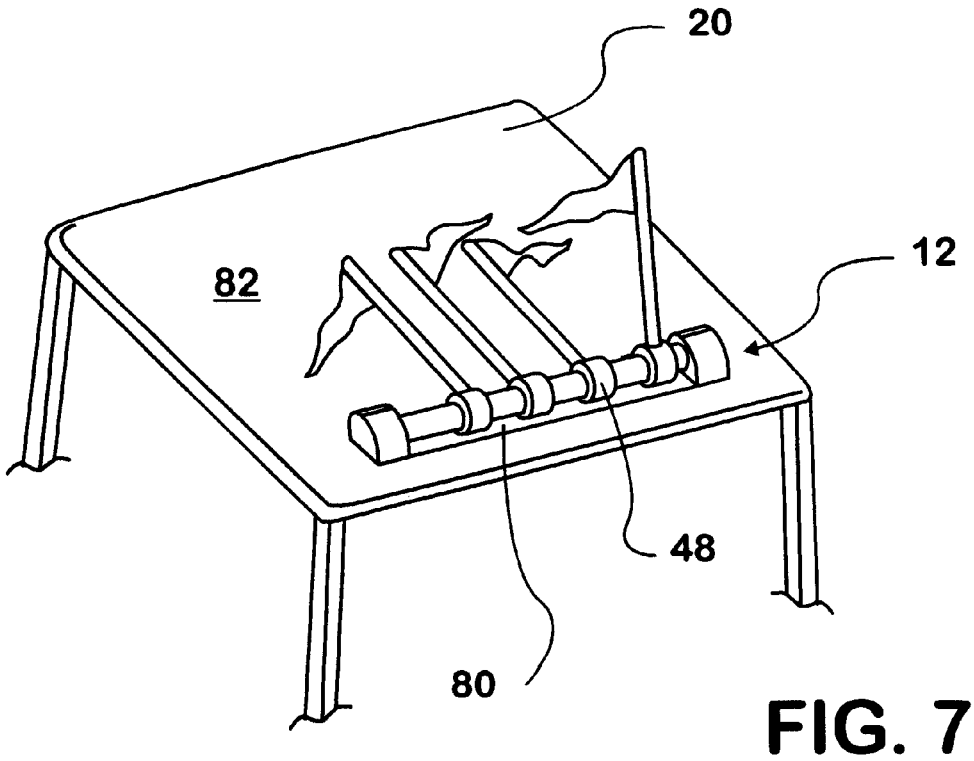
FIG. 7 is a perspective top view of the system of FIG. 6.

Although releasable mounting of the system 12 may be preferable, as shown in FIGS. 6 and 7, the system 12 may also be incorporated into and formed as part of the roof 20 of the golf cart 10. Also, if desired to create a lower profile, the roof 20 may incorporate an undercut area 80, as shown in FIG. 7, to allow the rings 48 to rotate about the rod 44 while being partially set below the level of the top 82 of the roof 20.

As described above, the golf cart signal flag system 12 provides a number of advantages, some of which have been described above and others which are inherent in the invention. Also, modifications may be proposed without departing from the teachings herein. Accordingly, the scope of the invention is only to be limited as necessitated by the accompanying claims.

What is claimed is:

1. A signal flag system for a golf cart comprising at least one flag mounted to a pole having a free end which is mechanically engaged to the golf cart in a manner to rotate between a locked vertical position elevating the flag above the golf cart and a horizontal nonelevated position with the flag incorporating indicia indicating a particular circumstances to players and golf course personnel when elevated, said free end of said pole releasably engaging a rotatable collar mounted on a support rod.

2. The system of claim 1 wherein said support rod is mechanically engaged to the golf cart.

3. The system of claim 2 wherein said support rod has a spring biased pin extending outwardly thereof at a predefined position and said rotatable collar has a slot on an interior surface thereof which releasably engages said pin locking said collar and said support rod together when said pole is vertically positioned.

4. The system of claim 3 wherein said free end of said pole engages within an opening for same in the collar.

5. The system of claim 4 wherein cooperating structures in said opening and said free end of said pole engage to releasably secure the free end of said pole within said opening when desired relative rotational alignment between them said opening and the free end of said pole exits.

6. The system of claim 1 wherein a base is provided for securing said support rod to said golf cart.

7. The system of claim 6 wherein said golf cart has a roof having a lip and wherein said base is configured to engage said roof lip.

8. The system of claim 6 wherein said golf cart has an upright post and wherein said base is configured to engage said upright post.

9. The system of claim 8 further including an extension rod extending upwardly from said base.

10. The system of claim 6 wherein said base is part of a roof of said golf cart.

11. The system of claim 10 wherein said roof includes an undercut area for distancing said suppport rod from said base.

12. The system of claim 7 wherein said base comprises a three sided member having a channel therein and having a plurality of compression plates movable across the channel from a first side toward a second side parallel to the first side, with a third side joining the first and second sides together.

13. The system of claim 9 wherein said base comprises two pieces which define an upright post engaging channel therebetween when the pieces are joined together.

14. The system of claim 9 wherein said base includes structure for engaging and maintaining said extension rod parallel to said channel.

* * * * *